US007441375B2

(12) United States Patent
Lang

(10) Patent No.: US 7,441,375 B2
(45) Date of Patent: Oct. 28, 2008

(54) COVER FOR POCKETS IN PRECAST CONCRETE PANELS

(76) Inventor: Frank J. Lang, 23225 Chipper Ct., Plainfield, IL (US) 60544

( * ) Notice: Subject to any disclaimer, the term of this patent is extended or adjusted under 35 U.S.C. 154(b) by 42 days.

(21) Appl. No.: 11/593,027

(22) Filed: Nov. 6, 2006

(65) Prior Publication Data

US 2008/0104897 A1 May 8, 2008

(51) Int. Cl.
*E02D 35/00* (2006.01)

(52) U.S. Cl. ..... 52/125.5; 52/701

(58) Field of Classification Search ..... 52/3–5, 52/125.4, 125.5, 127.7, 169.14, 396.05, 514, 52/698–701, 717.05, 718.01–718.06, 99, 52/133, 220.8, 301; 220/326, 787; 215/358, 215/359, 361; 114/227; 411/429, 431; 49/492.1; D8/386, 404; D25/58, 135; 301/108.3
See application file for complete search history.

(56) References Cited

U.S. PATENT DOCUMENTS

| | | | | |
|---|---|---|---|---|
| 1,800,173 | A * | 4/1931 | Anderson | 220/787 |
| 3,298,148 | A | 1/1967 | Dickson | |
| 3,873,147 | A | 3/1975 | Annable et al. | |
| 3,900,998 | A * | 8/1975 | Hubbard | 52/698 |
| 4,068,879 | A | 1/1978 | Torbet et al. | |
| 4,139,228 | A | 2/1979 | Varadi | |
| 4,157,640 | A | 6/1979 | Joannes | |
| 4,179,151 | A | 12/1979 | Tye | |
| 4,301,629 | A * | 11/1981 | Farr | 52/99 |
| 4,325,575 | A | 4/1982 | Holt et al. | |
| 4,383,674 | A | 5/1983 | Fricker | |
| 4,383,675 | A | 5/1983 | Fricker | |
| 4,386,486 | A * | 6/1983 | Holt et al. | 52/125.5 |
| 4,807,843 | A | 2/1989 | Courtois et al. | |
| 5,103,615 | A * | 4/1992 | Owens | 52/514 |
| 5,112,112 | A * | 5/1992 | Baba | 301/108.3 |
| 5,528,867 | A | 6/1996 | Thompson | |
| 6,092,849 | A | 7/2000 | Zambelli et al. | |
| 6,334,286 | B1 | 1/2002 | Zambelli et al. | |
| 6,460,824 | B1 | 10/2002 | Lancelot, III et al. | |
| 6,550,834 | B2 | 4/2003 | Fromelius | |

(Continued)

FOREIGN PATENT DOCUMENTS

| | | |
|---|---|---|
| JP | 06-341226 A | 12/1994 |

*Primary Examiner*—Richard E Chilcot, Jr.
*Assistant Examiner*—Bryan Eppes
(74) *Attorney, Agent, or Firm*—Breiner & Breiner, LLC

(57) ABSTRACT

A cover for concealing an open pocket, recess or the like in a precast concrete panel following removal of a form used for positioning an anchor in the concrete panel during manufacture thereof is disclosed. The cover includes a planar or flat or substantially planar or flat top sized to cover an open pocket in a precast concrete panel, and at least one projecting member extending outward from an underside of the top of the cover. Each projecting member has two opposed end walls joined by a cross wall having a lesser height than the height of the end walls. The cross wall is positioned operatively substantially perpendicular to the two end walls of the projecting member and is operatively connected to the end walls of the projecting member. The cross wall is under compression in use and supports the end walls which have sufficient flexibility to conform to the side walls of the pocket when positioned in the pocket. In use, the cover is unconnected to any exposed anchor or other structure present in the pocket.

17 Claims, 4 Drawing Sheets

U.S. PATENT DOCUMENTS 6,568,730 B1 5/2003 Paterson
6,688,049 B2 2/2004 Sanftleben et al.
6,694,680 B2 2/2004 Zambelli et al.
6,745,530 B2 * 6/2004 Nesbitt ..... 52/301
6,755,385 B2 6/2004 Lancelot, III et al.
6,779,312 B2 8/2004 Wright
7,222,460 B2 * 5/2007 Francies et al. ..... 52/3
2003/0140575 A1 7/2003 Sanftleben et al.
2003/0140576 A1 7/2003 Sanftleben
2004/0010985 A1 1/2004 Francies, III et al.
2004/0012216 A1 1/2004 Paterson
2004/0044805 A1 3/2004 Mac Farlane
2004/0168375 A1 9/2004 Sack
2007/0113490 A1 * 5/2007 Boyd ..... 52/133

* cited by examiner

COVER FOR POCKETS IN PRECAST CONCRETE PANELS

FIELD OF INVENTION

The present invention relates to a cover for concealing outwardly open pockets or the like in precast concrete panels. More particularly, the invention relates to a cover for concealing an outwardly open pocket or the like in a precast concrete panel which maintains its flexural and compressive strength in use positioned in the pocket in the precast concrete panel.

BACKGROUND OF INVENTION

Many buildings are constructed of concrete panels which are precast and then assembled. In the precast manufacturing process, the concrete panels are normally cast flat in a mold, lifted from the mold and transported, usually in a horizontal orientation, and then assembled at a construction site.

In lifting the precast panels to transport, position and assemble the panels, the concrete panels are handled by external hoist or lift devices which engage anchors preset in the precast panels during manufacture of the panels. With reference to FIG. 9, an anchor A (usually four to eight per panel) is positioned by means of a plastic form PF and embedded in the cement forming a precast panel. After the cement cures (generally, the next day), the plastic forms are removed by breaking apart each form which leaves an open pocket with the uppermost portion of the anchor exposed in the pocket. The open pockets left in the concrete panels enable access to the anchors for attachment to a hoist or lift device. Once the concrete panels are in place at a site, these open pockets in the concrete panels then, for appearances sake, need to be filled or covered so that the wall surface is smooth and uniform.

One method of closing the open pockets in the precast concrete panels is to fill the openings with concrete or other material such as a drywall patching compound. However, this can be messy and difficult since the panels are in a vertical orientation once assembled and the fill material tends to flow out of the pocket or requires a second coat due to shrinkage on the first fill. Another method of closing the open pockets in the precast concrete panels is to position a cover therein or thereover. However, known covers have various shortcomings including being ill-fitting, and being prone to warping and relaxing under flexural stress by the material of the cover, whereby the cover then becomes loose in the pocket and can easily fall out of or be easily removed from the pocket. Many of these known covers are also constructed of a material that is weak, relaxes under pressure and does not allow paint to easily bond thereto.

The prior art discloses various recess or void filling devices. For example, U.S. Patent Application Publication No. 2004/0010985 A1 discloses a cover for use with concrete construction to cover a recess formed around an anchor embedded in the concrete. The cover includes a disk-shaped body to cover a recess to surround an anchor. First and second anchor engaging members extend from the body and receive the anchor therebetween. A plurality of fins are present on the anchor engaging members and have a height such that the fins positively engage the anchor. The fins are deformed to either resiliently or frictionally engage the anchor and thereby retain the cover in place over the recess.

U.S. Pat. No. 4,325,575 discloses a sealing plug which is inserted into a recess in a concrete slab once the hoist coupling used to lift the slab is removed. The plug includes a disk-shaped top and a cylindric extension dimensioned for a snug fit in a passage. The top is described as being slightly larger in diameter than the opening in the concrete slab.

U.S. Pat. No. 5,528,867 discloses a cover to be placed over a rod or hook embedded in a precast concrete block. The cover engages the rod or hook during transportation, manipulation and after installation of the block. The cover is of high density polyethylene and includes a platter and a vessel with a continuous sidewall. An internal hollow pocket is provided by the sidewalls. At least one slit is present in a vertical wall of the vessel. A cover member mates with a concrete wall and mechanically engages the rod or hook that extends out of the precast concrete block. The cover allows for movement of the block while the cover remains in place.

U.S. Pat. No. 4,386,486 discloses a cover plate for recesses in wall slabs. The cover plate includes a pair of peripheral pins which fit in passageways of a connector plug. The plug is attached to an anchor insert. The plate and pins can be molded as one piece and of plastic. The plate is stated to be large enough to cover the recess in the slab.

Japanese Published Application No. 06-341226 A discloses a core for embedment in concrete. The core includes a cover member fitted to the open end of the core so as to be flush with the concrete. The cover, on its underside, is shown to include four downward projections wherein two are inserted inside a female screw hole and two encompass the outside of the screw hole.

U.S. Pat. Nos. 6,460,824 B1 and 6,755,385 B2 disclose a void former and a cover used in casting a concrete block. The void former is attached to an anchor. The cover is attached to form work prior to casting. The cover includes pegs. These pegs align with bores in the void former to attach the void former to the cover. The concrete is then poured and allowed to harden. The cover is then removed.

Also known are various inserts or void-formers which are embedded in concrete including U.S. Pat. Nos. 3,298,148; 3,873,147; 4,068,879; 4,139,228; 4,179,151; 4,383,674; 4,383,675; 6,092,849; 6,334,286 B1; 6,550,834 B2; 6,688,049 B2; 6,694,680 B2; and 6,779,312 B2; and U.S. Patent Application Publication Nos. 2003/0140575 A1; 2003/0140576 A1; 2004/0168375 A1; and 2004/0044805 A1.

Also known are various void formers, recess plugs and prefabricated building panels including U.S. Pat. Nos. 4,157,640; 4,807,843; and 6,568,730 B1; and U.S. Patent Application Publication No. 2004/0012216 A1.

These known devices all have various shortcomings including being ill-fitting in a pocket, are prone to warping, prone to loss of strength under stress, easily removed from a recess in a precast concrete panel and poor adhesion of paint thereto. These and other shortcomings of these devices are addressed by the present invention.

SUMMARY OF INVENTION

The invention concerns a cover for concealing an open pocket, recess or the like in a precast concrete panel following removal of a form used to embed a lift bar in the precast concrete panel. The cover maintains its flexural and compressive strengths while in the open pocket, recess or the like in the precast concrete panel due to the cover's construction.

The cover comprises a top portion sized to conceal an open pocket in a precast concrete panel, and at least one projecting member extending outward from an underside of the top portion. The top portion of the cover is preferably disk-shaped.

A preferred embodiment of the cover comprises two projecting members. However, the cover may comprise any suitable number of projecting members based on the size of the open pocket to be concealed. The two projecting members are operatively positioned in a spaced relationship to each other. The spacing is preferably such so as to allow an exposed anchor in the pocket to be positioned between the two projecting members and, thus, provide a balanced fit.

Each projecting member has two opposed end walls, i.e., a first end wall and a second end wall, joined by a cross wall or rib having a lesser height than the height of the end walls. The end walls of the projecting members direct insertion of the cover into an open pocket in a precast concrete panel and abut the interior walls of the pocket. The upper portion of the projecting members are flexible to allow the projecting members to conform to the draft or taper of the pocket walls. The cross wall provides support to the end walls and is under compression in use, thereby providing the end walls with support for maintaining position of the projecting members, and thus cover, in the open pocket in the precast concrete panel. The end walls are preferably slightly tapered inward from the base to the top end of each wall. This provides for a tighter fit once the cap is in place for use.

The cover is made of plastic, preferably acrylonitrile butadiene styrene (ABS) and formed by molding. The compressive stress of ABS is approximately at least twice that of its flexural strength. ABS also provides for good adhesion to paint thereto which allows for improving the aesthetic appearance of the cover once in place in a wall. Since the side walls of the pocket are made by a molded plastic part, the side walls are very predictable and usually vary in an amount of within about 0.01 to 2.5 mm. The location of the exposed anchor, however, can vary up to about ¾" due to variation in position. Since the cover of the invention does not attach to the exposed anchor, the position of the anchor within the pocket is inconsequential.

The cross wall is operatively positioned substantially perpendicular to the end walls of the projecting member and is operatively connected to each end wall of each projecting member. Since the cross wall is under compression in use, the cross wall supports the end walls. The cross wall may be in the form of two fillets joined by a cross bar to provide a rib under compression during use.

The cover allows insertion thereof into an open pocket, recess or the like in a precast concrete panel and retains its strength and position within the open pocket and is not subject to stress relaxation due to the cross wall being under compression.

Further, the cover is strong, flexible and easy to install and manufacture as well as made of a material which has excellent properties for the adhesion of paint thereto.

BRIEF DESCRIPTION OF THE DRAWINGS

Referring to the drawings.

DETAILED DESCRIPTION OF THE PREFERRED EMBODIMENTS

Figure 1:
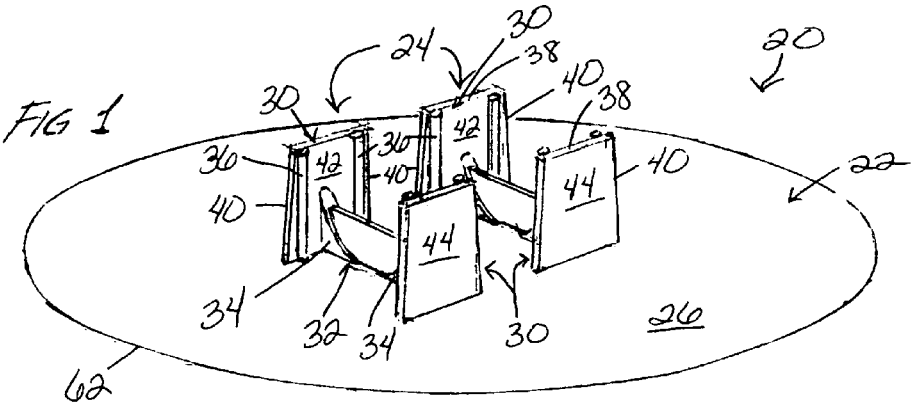
FIG. 1 is a perspective view of a cover for concealing an open pocket in a precast concrete panel of the present invention.

The invention concerns a cover 20 for concealing an open pocket, recess or the like present in a precast concrete panel following removal of a form for positioning an anchor in the precast concrete panel. The cover 20 maintains its flexural strength and position due to being under compression while in position in the open pocket in the precast concrete panel due to its structure.

Referring to FIGS. 1-7, cover 20 comprises a planar or flat or substantially planar or flat top portion 22 sized to conceal an open pocket in a precast concrete panel. The top portion 22 has an underside 26, an outer side 28 and a peripheral edge 62. The top portion 22 is preferably disk-shaped. The cover 20 also comprises at least one projecting member 24, and more preferably two projecting members 24, extending outward from the underside 26 of the top portion 22. While the cover 20 preferably comprises two projecting members 24, the cover 20 may comprise any suitable number of projecting members 24 based on the size of the open pocket to be concealed. The projecting members 24 are operatively positioned in spaced relation to each other. The projecting members 24 are arranged in any suitable orientation on the top portion 22 based on the interior side wall orientation of the open pocket to be concealed.

Figure 3A:
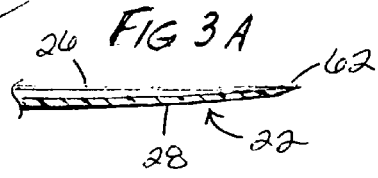
FIG. 3A is a detailed cross-sectional view of the cover of FIG. 3 along line 3A-3A.
Figure 3:
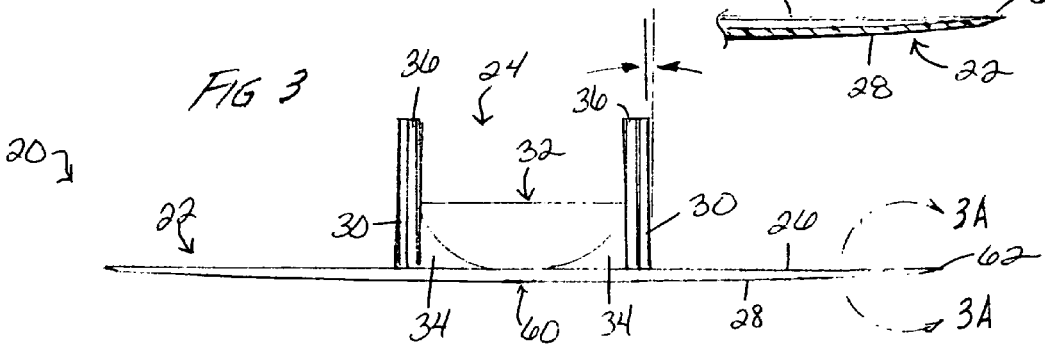
FIG. 3 is a side view of the cover of FIG. 1.
Figure 4:
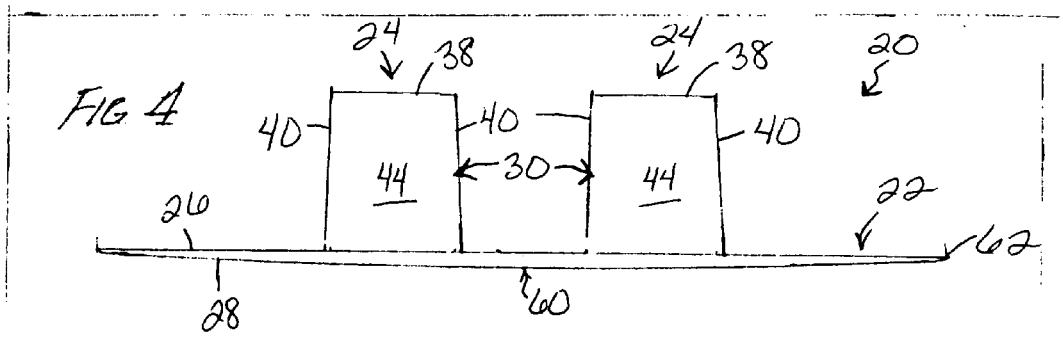
FIG. 4 is an end view of the cover of FIG. 1.
Figure 5:
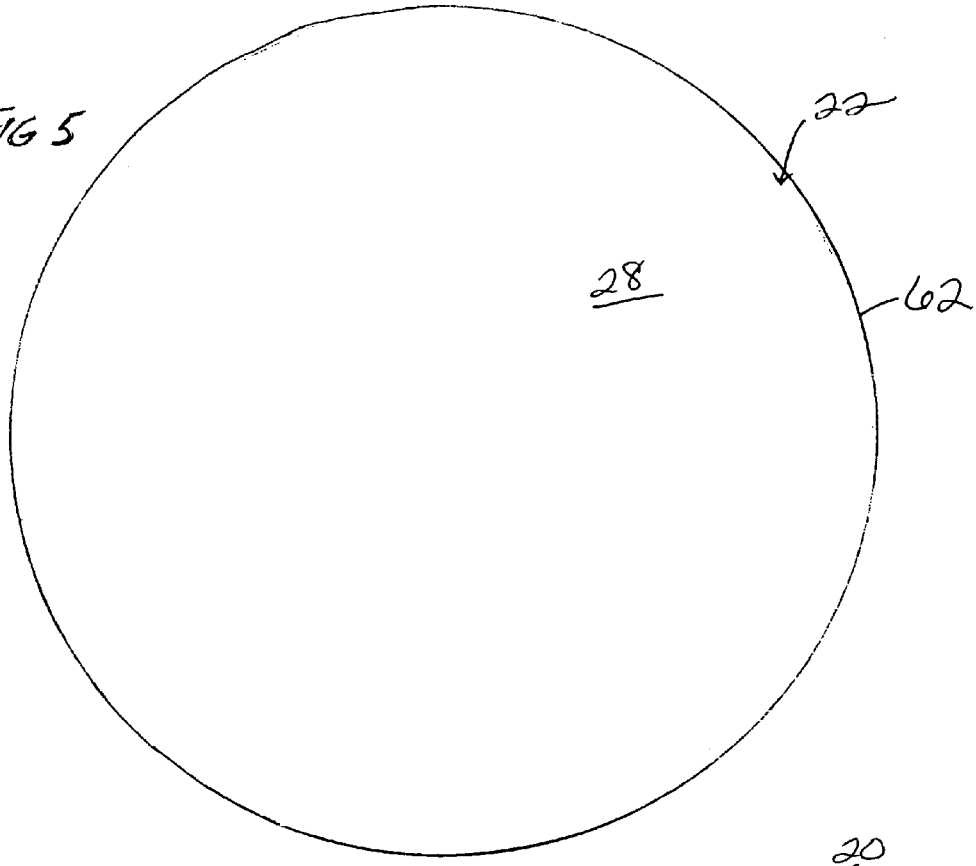
FIG. 5 is a top plan view of the cover FIG. 1.
Figure 6:
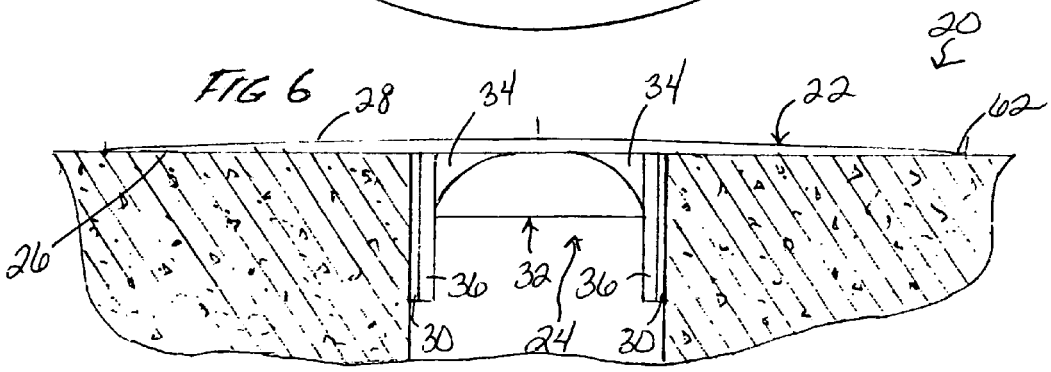
FIG. 6 is side view of the cover of FIG. 1 in an environment of use in an open pocket in a precast concrete panel.

Each projecting member 24 has two opposed end walls 30, i.e., a first end wall and a second end wall, joined by a cross wall 32 having a lesser height than the height of the end walls 30, such as shown for example in FIGS. 1, 3 and 6. Each of end walls 30 include an inner side 42 and an outer side 44. In one embodiment, end walls 30 are slightly tapered inward such that the distance between the free ends 38 of the end walls 30 is less than the distance between the bottom ends of the end walls 30, i.e., the ends that are operatively connected to the top portion 22 of the cover 20, such as shown for example in FIG. 3. The end walls 30 of the projecting member 24 direct insertion of the cover 20 into an open pocket in a precast concrete panel and abut the interior side walls of the pocket once in place in the pocket. In another embodiment, the end walls 30 are not tapered and are substantially parallel to each other and substantially perpendicular to the top portion 22 of the cap 20. The end walls 30 may also have any other suitable orientations since the end walls are provided with flexural strength that allows them to conform to the interior side walls of an open pocket.

Figure 2:
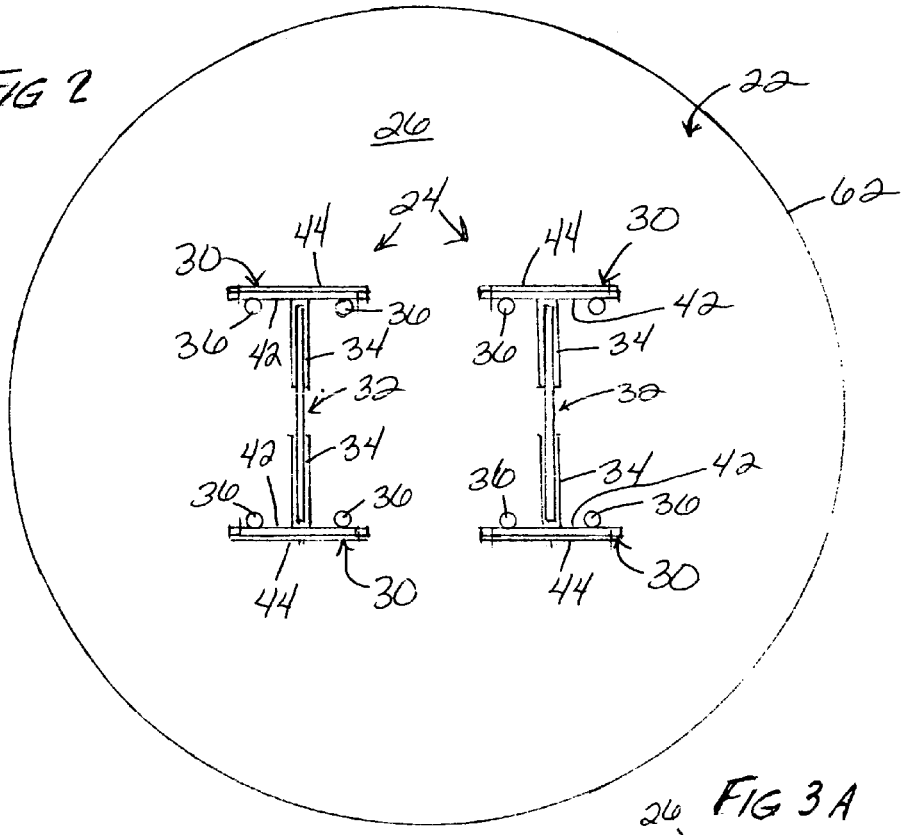
FIG. 2 is a bottom plan view of the cover of FIG. 1.

Each end wall 30 may have at least one member 36, preferably two members 36, such as shown for example in FIGS. 1 and 2, on the inside surface of the end wall to provide contact structure for an ejection pin or pins to release the cover from a mold during manufacture of the cover. The cover 20 is constructed of plastic, in particular a plastic which has good flexural and compressive strengths, and also preferably provides good adhesion to paint, such as for example acrylonitrile butadiene styrene (ABS). The contact structures for the ejection pins are on the inside of the end walls so as not to interfere with the fit of the end walls to the side walls of the pocket. These contact surfaces are not necessary to the operation of the cover in use within a pocket in a precast concrete panel.

The cross wall or nib 32 is operatively positioned substantially perpendicular to the end walls 30 of the projecting member 24 and is operatively connected to the end walls 30 of the projecting member 24. The cross wall 32 has a first end, a second end, a top edge, a bottom edge, and a panel portion. In a preferred embodiment, the bottom edge of the cross wall 32 operatively connects to the underside 26 of the top portion 22 of the cover 20, the top edge is a free edge, the first end of the cross wall 32 operatively connects to the inner side 42 of first end wall 30 and the second end of the cross wall 32 operatively connects to inner side 42 of second end wall 30 of the projecting member 24. The cross wall 32 provides support for the end walls 30 in use in an open pocket in a precast concrete panel since the cross wall is under compression at that time. In one embodiment, the cross wall 32 is straight or linear, such as shown for example in FIGS. 1-3 and 6. In another embodiment, the cross wall may have multiple curvatures therein or be any other suitable configuration so long as the desired compression is obtained in use.

The cross wall 32 may have at least one fillet 34. In a preferred embodiment, the cross wall has two fillets 34. The substantially triangular shape of the fillets, such as shown for example in FIGS. 1, 3 and 6, provide added support to the cross wall. The use of fillets alone to support members 30 has been found to be inadequate. Compression was not provided and the projecting members became subject to stress relaxation due to inadequate support.

The top portion 22 of the cover 20 is preferably disk-shaped. The center portion 60 of the top portion 22 may be slightly thicker than the peripheral edge 62 of the top portion 22, such as shown for example in FIGS. 3 and 3A. The top portion 22 provides a smooth exterior surface to the precast concrete panel in the area of the open pocket when the cover 20 is inserted in the open pocket. The cover 20 is preferably made of molded plastic. The mold is center gated or filled, thus, allowing the molten plastic to have good flow from the center to the edges resulting in a domed shaped, thicker in the center and thinner at the outer edges. The center gated formation also results in uniform material shrinkage toward the center of the cover resulting in a flat top surface in the cover. This enables strength in the center area and edges while aesthetically allowing the edges to blend into the concrete wall and provide a flatter appearance as compared to known caps. Known caps are edge filled and thus have an overall thicker structure which are usually ill-fitting and subject to warpage. This can result in stress relaxation and falling out or easy removal of the cap from a pocket.

Figure 7:
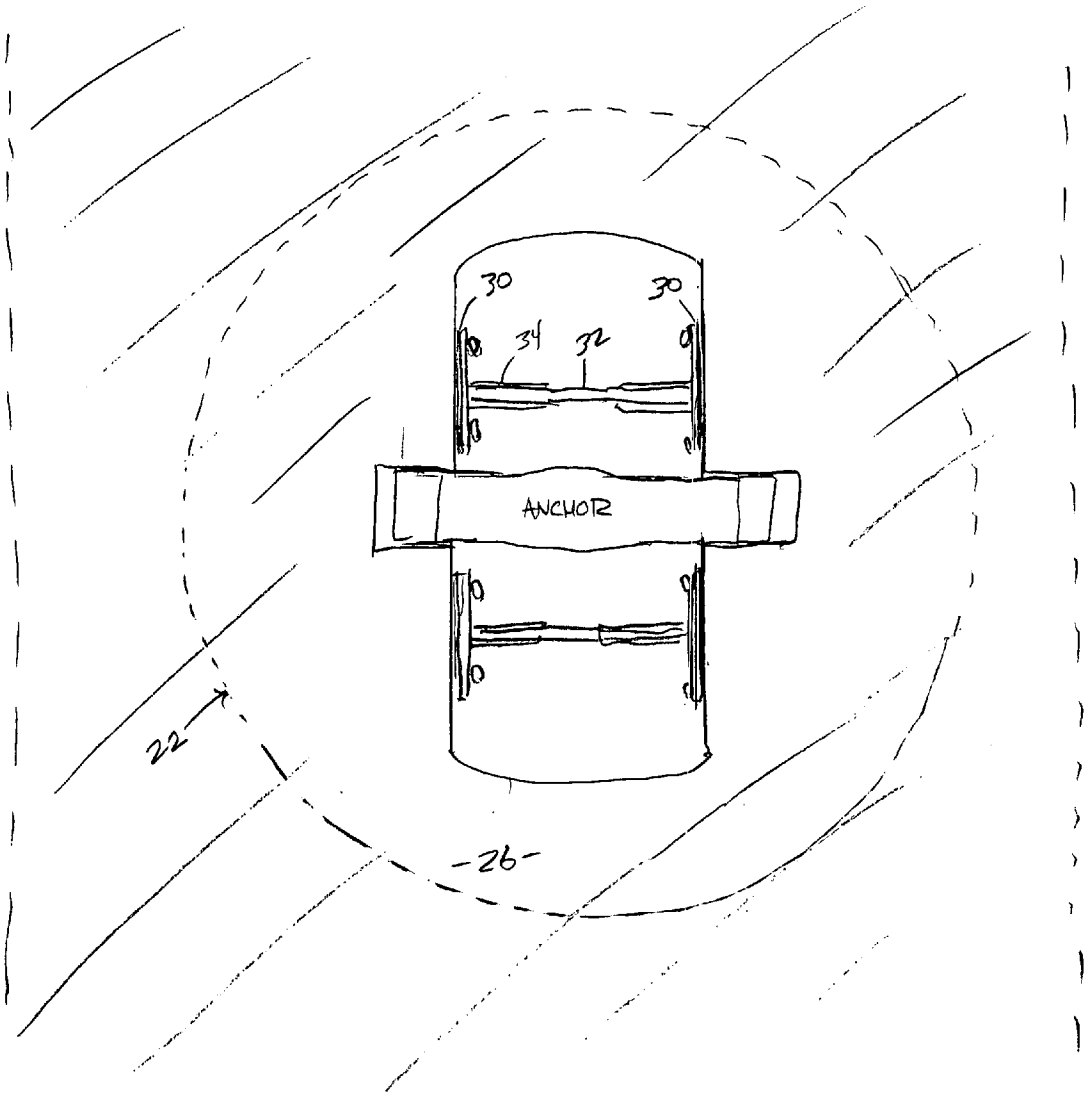
FIG. 7 is a bottom view of the cover of FIG. 1 in position in an open pocket containing an exposed portion of an anchor in a precast concrete panel.
Figure 8:
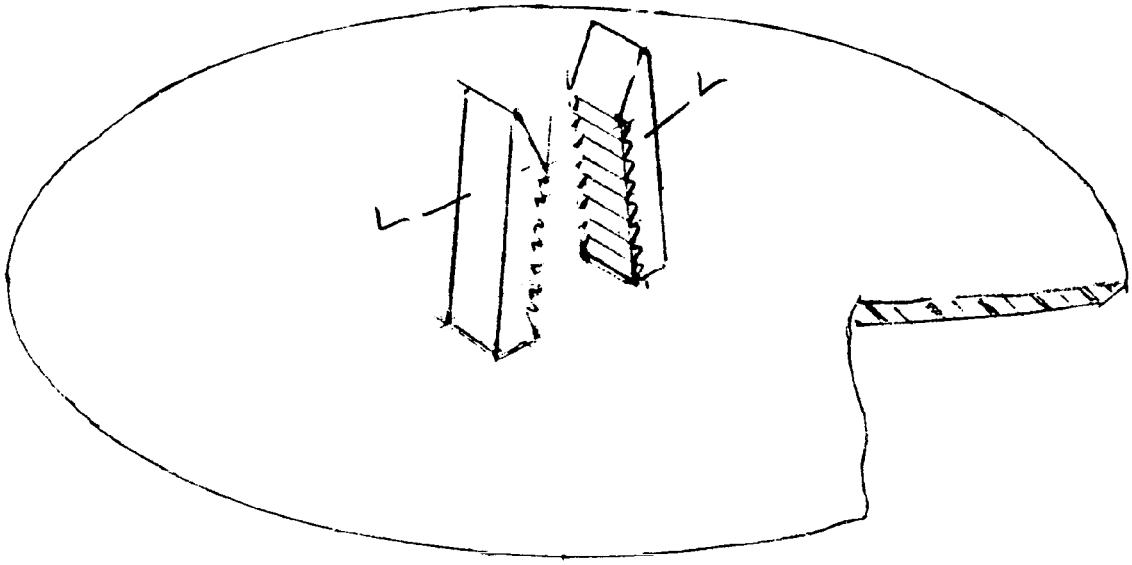
FIG. 8 is a perspective view of a prior art recess cover for a precast concrete panel.
Figure 9:
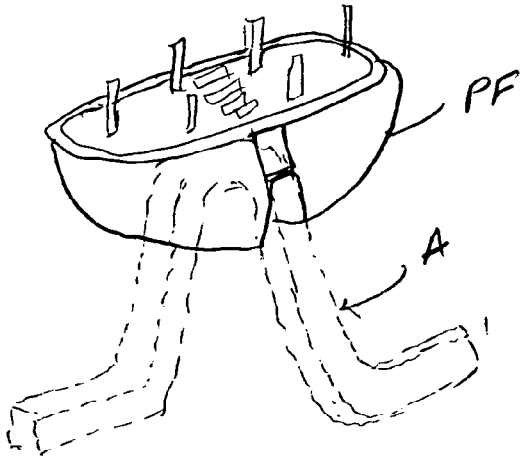
PRIOR ART FIG 9
FIG. 9 is an example of a plastic form for making a pocket and positioning an anchor in a precast concrete panel, with an anchor as held in the form being shown by broken lines.
Figure 1:
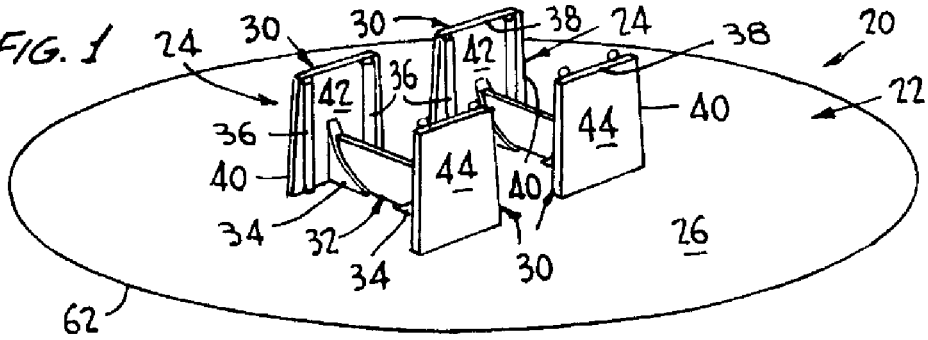
Figure 2:
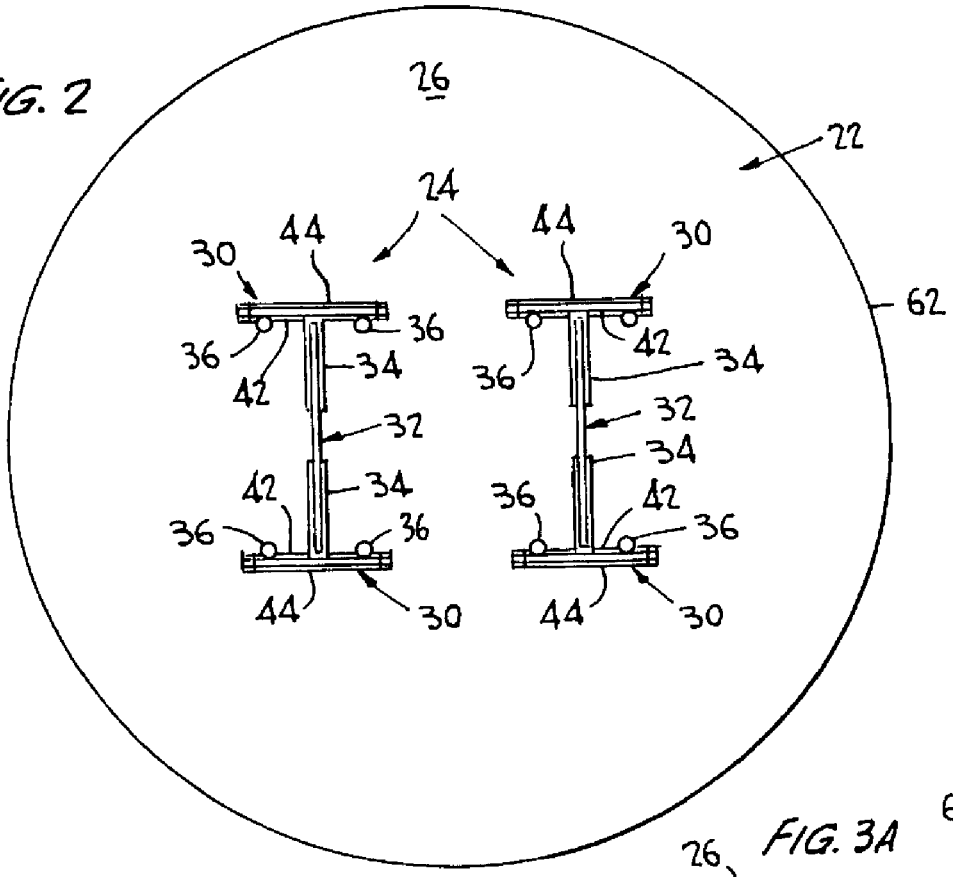
Figure 3A:
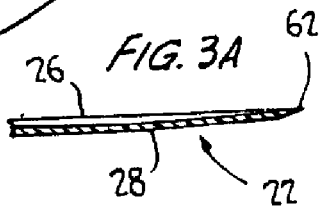
Figure 3:
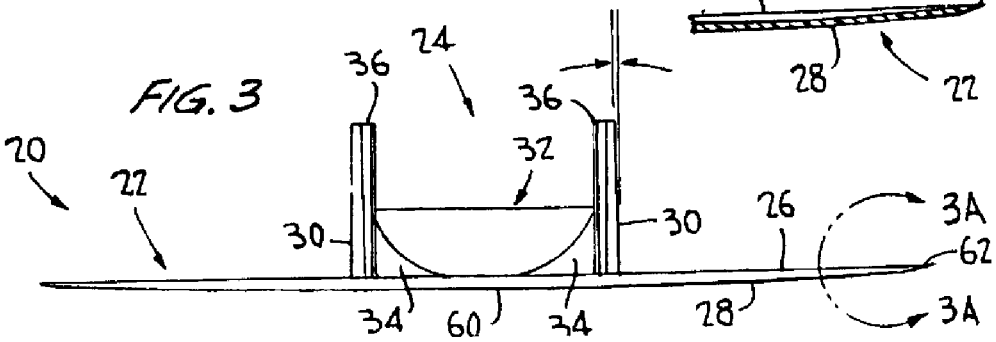
Figure 4:
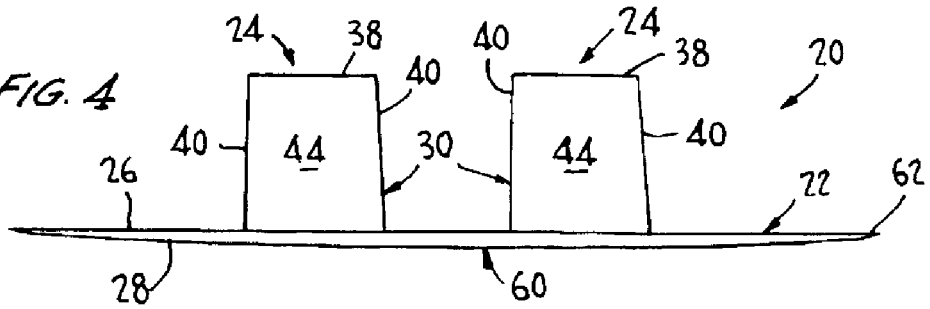
Figure 5:
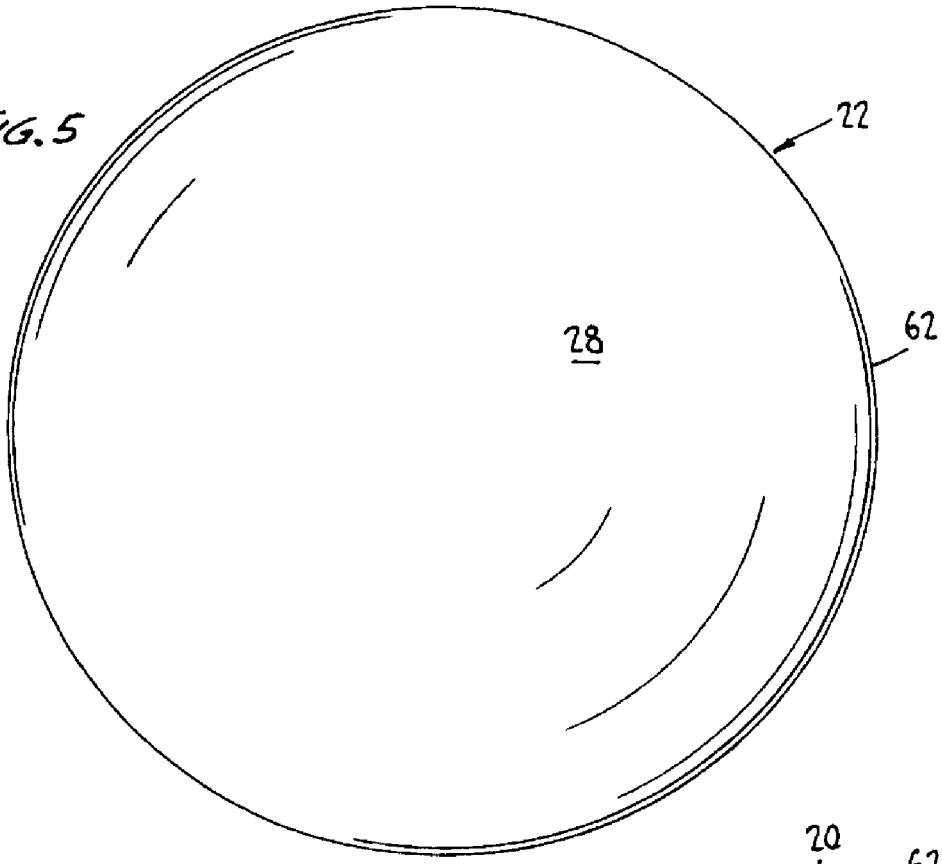
Figure 6:
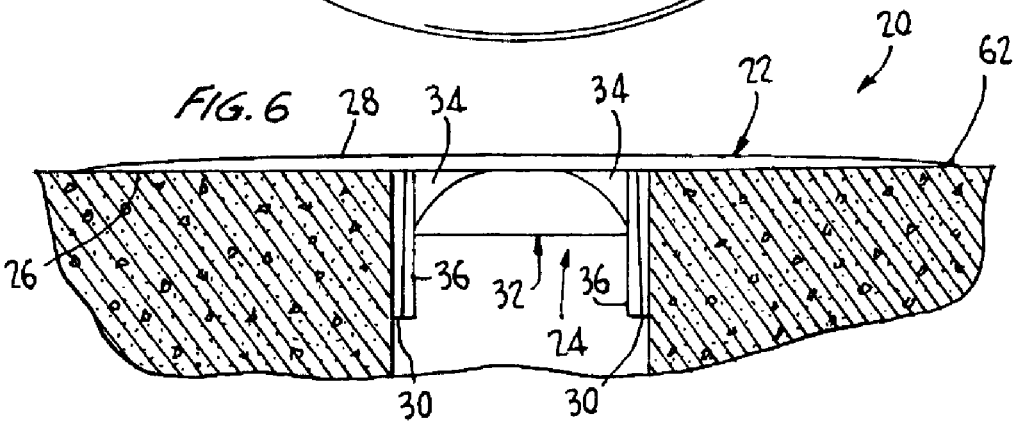
Figure 7:
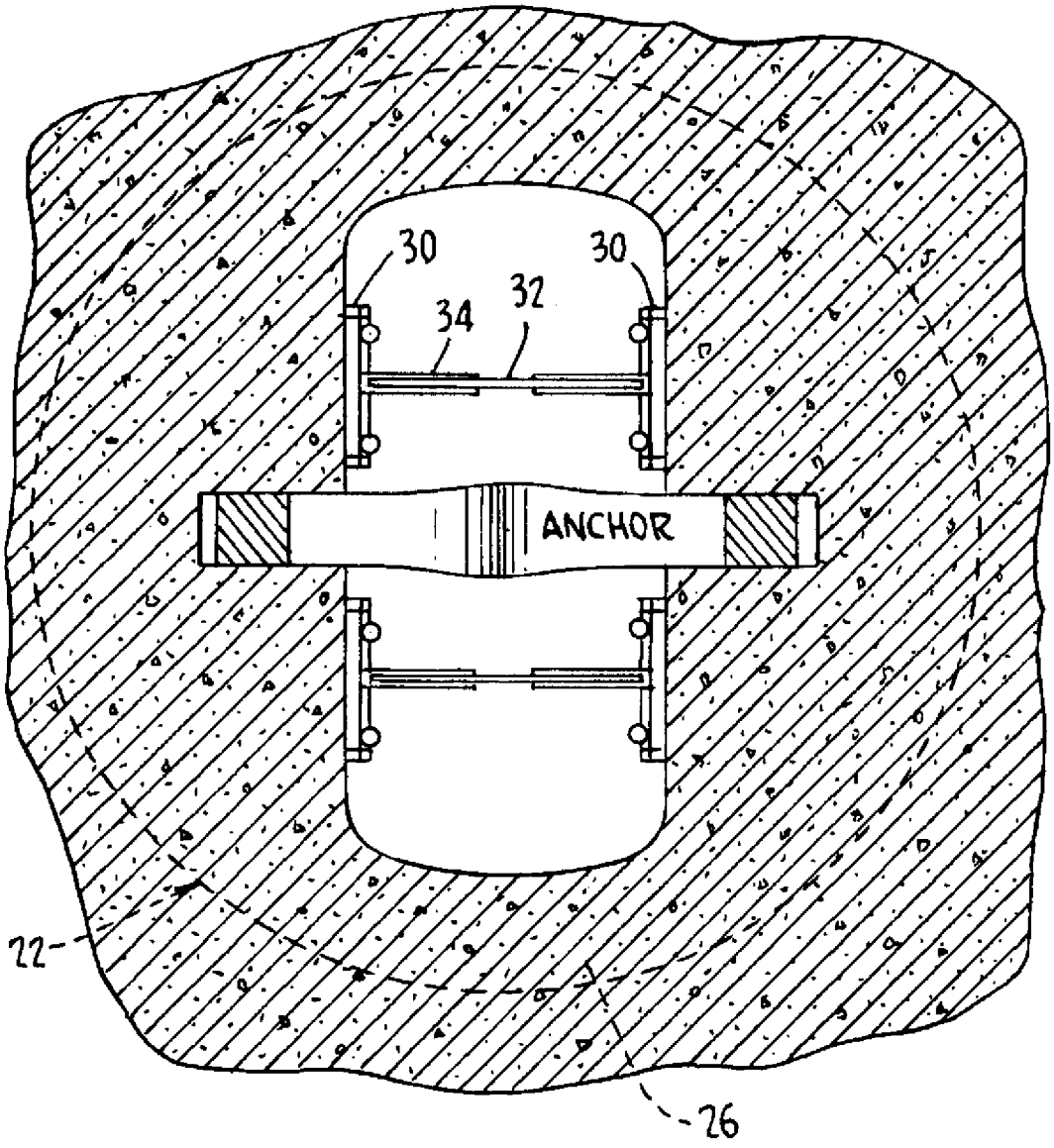
Figure 8:
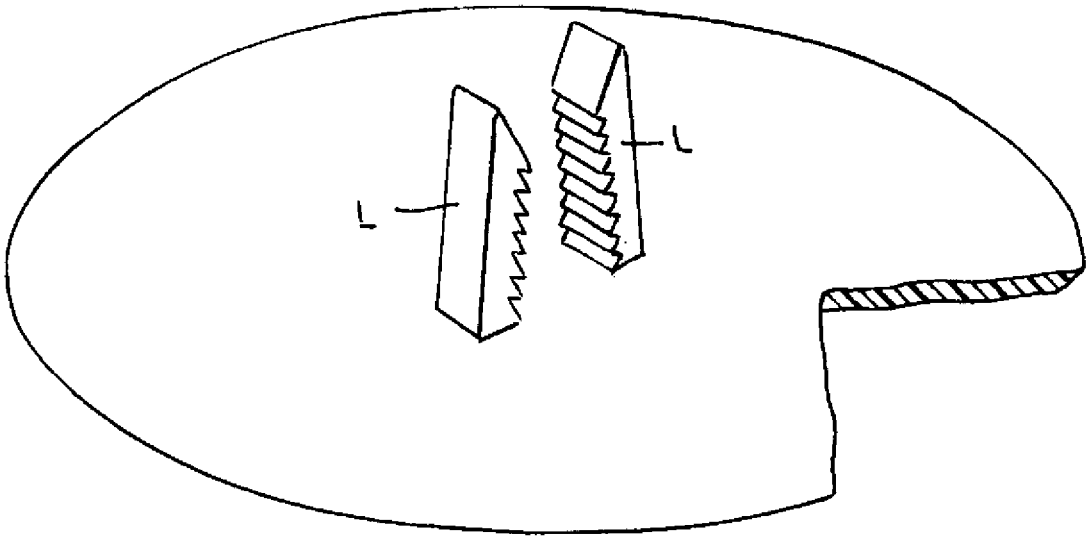
FIG. 8 (PRIOR ART)
Figure 9:
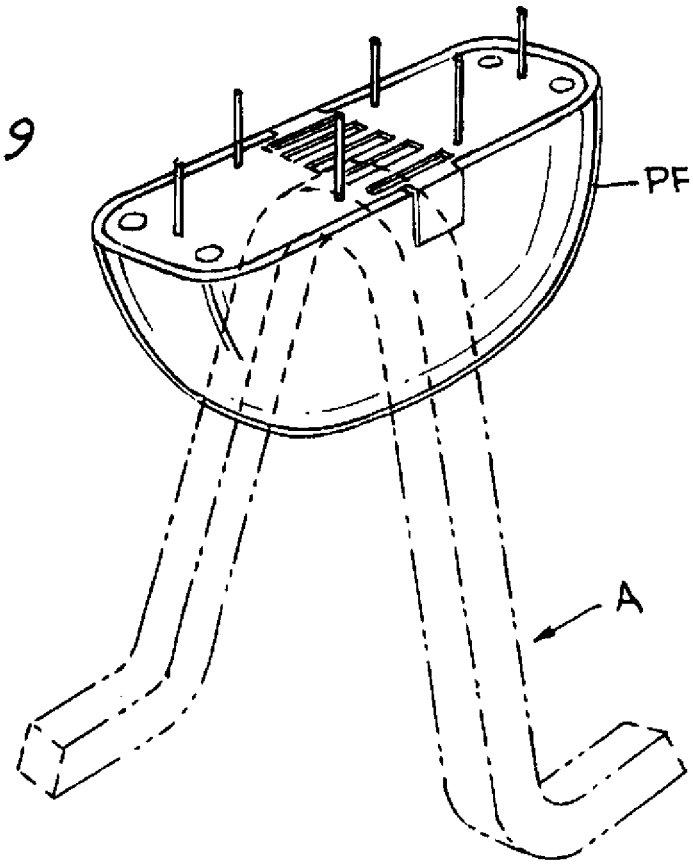

In use, the projecting members 24 of the cover 20 are pressed into an open pocket in a precast concrete panel. The two projecting members 24 have some flexibility allowing the members to conform to the interior side walls of a pocket when they abut the interior side walls of the pocket. Once in position, the cross wall is under compression. The projecting members 24 resist the tendency to loosen when inside the pocket since any relaxation of the material simply results in further conformation to the side walls of the pocket. The cover 20 does not require attachment to any bar or anchor within the pocket as shown in FIG. 7. Prior art caps, such as shown in FIG. 8, in contrast include legs L which grab an anchor within a pocket. Eventually, the stress of the legs relaxes and tension becomes less resulting in loosening of the legs and, thus, loosening of the cap in the pocket. Since the cover of the invention is under compression, no change in fit occurs.

The cover 20 may be made of any suitable plastic material which has good flexural strength and compressive strength. Preferably, the cover 20 is made of acrylonitrile butadiene styrene (ABS). The properties of ABS provide conformation to stress rather than fighting the stress and cracking, thus, providing good sealing with the interior walls of the pocket and the exterior surface of the precast panel. The compressive strength of ABS serves to maintain a strong hold in the pocket. The compressive strength of ABS is approximately twice that of its flexural strength. ABS also provides the desired property in the plastic of good adhesion for paint to the cover 20. This enables the cover 20 to be easily painted over and blended in appearance to the exterior surface of the panel and to provide a smooth panel surface.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A cover for concealing an open pocket in a precast concrete panel, said cover comprising:

a top portion having an underside, an outward side and a peripheral edge, said top portion being planar or substantially planar and sized to conceal an open end of said pocket in said precast concrete panel; and at least two projecting members operatively connected to said underside of said top portion, wherein each of said at least two projecting members comprises:

a first end wall having a free top end and a base end operatively connected to said underside;

a second end wall having a free top end and a base end operatively connected to said underside, said second end wall being operatively positioned substantially opposed to said first end wall; and a cross wall having a first end, a second end, a bottom edge, and a top edge, said cross wall being operatively connected to said first end wall and said second end wall, wherein a first outer side of said first end wall and a second outer side of said second end wall are constructed and arranged to abut a side wall of said pocket when operably inserted therein.

2. The cover of claim 1, wherein a distance between said free top end of said first end wall and said free top end of said second end wall is less than a distance between said base end of said first end wall and said base end of said second end wall.

3. The cover of claim 1, further comprising a first cross wall fillet operatively connected to said first end of said cross wall adjacent a juncture of said first end of said cross wall and said first end wall and a second cross wall fillet operatively connected to said second end of said cross wall adjacent a juncture of said second end of said cross wall and said second end wall.

4. The cover of claim 1, wherein each of said at least two projecting members is operatively joined to said underside of said top portion in a substantially central portion of said underside.

5. The cover of claim 1, wherein a first projecting member is in substantial spaced alignment with a second projecting member.

6. The cover of claim 1, wherein said top portion is substantially dome-shaped such that a central portion of said top portion is thicker than a peripheral edge of said top portion.

7. The cover of claim 1, wherein said top portion is substantially circular in shape.

8. The cover of claim 1, wherein said top portion and said at least one projecting member is made of plastic.

9. The cover of claim 8, wherein said plastic is acrylonitrile butadiene styrene.

10. The cover of claim 1, wherein said cross wall has a height less than a height of said first end wall, or a height less than a height of said second end wall, or a height less than a height of said first end wall and said second end wall.

11. The cover of claim 1, wherein each of said at two least projecting members has sufficient flexibility to conform to side walls of said open pocket once inserted therein.

12. The cover of claim 1, wherein said cross wall is under compression once said at least two projecting members are inserted in said open pocket.

13. A cover for concealing an open pocket in a precast concrete panel, said cover comprising:

a top portion having an underside, an outward side and a peripheral edge, said top portion being planar or substantially planar and sized to conceal an open end of said pocket in said precast concrete panel; and at least one projecting member operatively connected to said underside of said top portion, wherein said at least one projecting member comprises:

a first end wall having a free top end and a base end operatively connected to said underside, wherein distance between said free top end and said base end define length of said first end wall;

a second end wall having a free top end and a base end operatively connected to said underside, wherein distance between said free top end and said base end define length of said second end wall, said second end wall being operatively positioned substantially opposed to said first end wall; and a cross wall having a first end, a second end, a bottom edge, and a top edge, said cross wall being operatively connected to said first end wall and said second end wall;

wherein said at least one projecting member has sufficient flexibility to conform said first end wall and said second end wall to side walls of said open pocket once inserted therein such that said length of said first end wall and said length of said second end wall entirely abut said side walls of said pocket; and wherein said cross wall is under compression once said at least one projecting member is inserted in said open pocket.

14. The cover of claim 13, wherein a distance between said free top end of said first end wall and said free top end of said second end wall is less than a distance between said base end of said first end wall and said base end of said second end wall.

15. The cover of claim 13, wherein said cross wall has a height less than a height of said first end wall, or a height less than a height of said second end wall, or a height less than a height of said first end wall and said second end wall.

16. The cover of claim 13, further comprising a second projecting member.

17. The cover of claim 16, wherein a first projecting member is in substantial spaced alignment with said second projecting member.

* * * * *

UNITED STATES PATENT AND TRADEMARK OFFICE

CERTIFICATE OF CORRECTION

PATENT NO. : 7,441,375 B2
APPLICATION NO. : 11/593027
DATED : October 28, 2008
INVENTOR(S) : Frank J. Lang It is certified that error appears in the above-identified patent and that said Letters Patent is hereby corrected as shown below:

Delete the Title Page and substitute the corrected Title Page showing illustrative figure.

Delete Drawing Sheets 1-4 and substitute therefore the attached Drawing Sheets 1-4.

Signed and Sealed this

Third Day of November, 2009

David J. Kappos

David J. Kappos
*Director of the United States Patent and Trademark Office*

(12) United States Patent
Lang

(10) Patent No.: US 7,441,375 B2
(45) Date of Patent: Oct. 28, 2008

(54) COVER FOR POCKETS IN PRECAST CONCRETE PANELS

(76) Inventor: Frank J. Lang, 23225 Chipper Ct., Plainfield, IL (US) 60544

( * ) Notice: Subject to any disclaimer, the term of this patent is extended or adjusted under 35 U.S.C. 154(b) by 42 days.

(21) Appl. No.: 11/593,027

(22) Filed: Nov. 6, 2006

(65) Prior Publication Data

US 2008/0104897 A1 May 8, 2008

(51) Int. Cl.
*E02D 35/00* (2006.01)

(52) U.S. Cl. ..... 52/125.5; 52/701

(58) Field of Classification Search ..... 52/3–5, 52/125.4, 125.5, 127.7, 169.14, 396.05, 514, 52/698, 701, 717.05, 718.01–718.06, 99, 52/133, 220.8, 301; 220/326, 787; 215/358, 215/359, 361; 114/227; 411/429, 431; 49/492.1; D8/386, 404; D25/58, 135; 301/108.3
See application file for complete search history.

(56) References Cited

U.S. PATENT DOCUMENTS

| | | | | | |
|---|---|---|---|---|---|
| 1,800,173 | A | * | 4/1931 | Anderson | 220/787 |
| 3,298,148 | A | | 1/1967 | Dickson | |
| 3,873,147 | A | | 3/1975 | Annable et al. | |
| 3,900,998 | A | * | 8/1975 | Hubbard | 52/698 |
| 4,068,879 | A | | 1/1978 | Torbet et al. | |
| 4,139,228 | A | | 2/1979 | Varadi | |
| 4,157,640 | A | | 6/1979 | Joannes | |
| 4,179,151 | A | | 12/1979 | Tye | |
| 4,301,629 | A | * | 11/1981 | Farr | 52/99 |
| 4,325,575 | A | | 4/1982 | Holt et al. | |
| 4,383,674 | A | | 5/1983 | Fricker | |
| 4,383,675 | A | | 5/1983 | Fricker | |
| 4,386,486 | A | * | 6/1983 | Holt et al. | 52/125.5 |
| 4,807,843 | A | | 2/1989 | Courtois et al. | |
| 5,103,615 | A | * | 4/1992 | Owens | 52/514 |
| 5,112,112 | A | * | 5/1992 | Baba | 301/108.3 |
| 5,528,867 | A | | 6/1996 | Thompson | |
| 6,092,849 | A | | 7/2000 | Zambelli et al. | |
| 6,334,286 | B1 | | 1/2002 | Zambelli et al. | |
| 6,460,824 | B1 | | 10/2002 | Lancelot, III et al. | |
| 6,550,834 | B2 | | 4/2003 | Fromelius | |

(Continued)

FOREIGN PATENT DOCUMENTS

| | | |
|---|---|---|
| JP | 06-341226 A | 12/1994 |

*Primary Examiner*—Richard E Chilcot, Jr.
*Assistant Examiner*—Bryan Eppes
(74) *Attorney, Agent, or Firm*—Breiner & Breiner, LLC

(57) ABSTRACT

A cover for concealing an open pocket, recess or the like in a precast concrete panel following removal of a form used for positioning an anchor in the concrete panel during manufacture thereof is disclosed. The cover includes a planar or flat or substantially planar or flat top sized to cover an open pocket in a precast concrete panel, and at least one projecting member extending outward from an underside of the top of the cover. Each projecting member has two opposed end walls joined by a cross wall having a lesser height than the height of the end walls. The cross wall is positioned operatively substantially perpendicular to the two end walls of the projecting member and is operatively connected to the end walls of the projecting member. The cross wall is under compression in use and supports the end walls which have sufficient flexibility to conform to the side walls of the pocket when positioned in the pocket. In use, the cover is unconnected to any exposed anchor or other structure present in the pocket.

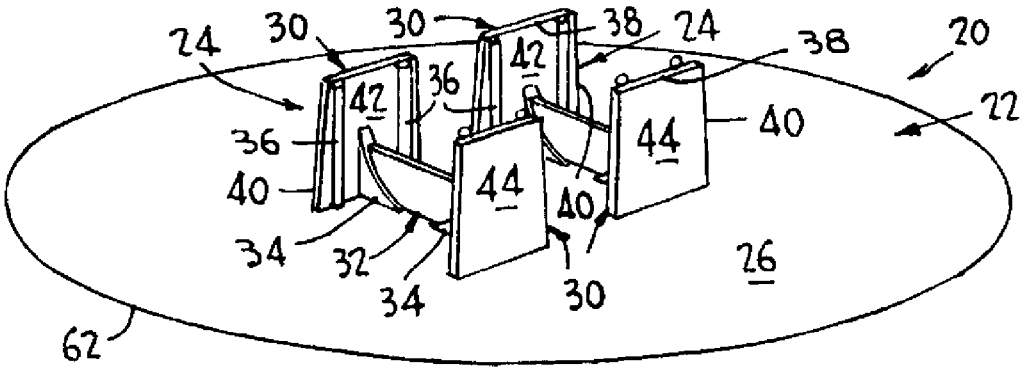

17 Claims, 4 Drawing Sheets